US010406829B2

(12) United States Patent
Miyakoshi et al.

(10) Patent No.: US 10,406,829 B2
(45) Date of Patent: Sep. 10, 2019

(54) INK JET RECORDING METHOD AND INK JET RECORDING APPARATUS

(71) Applicant: CANON KABUSHIKI KAISHA, Tokyo (JP)

(72) Inventors: Toshimori Miyakoshi, Yokohama (JP); Ryosuke Hirokawa, Kawasaki (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/414,714

(22) Filed: Jan. 25, 2017

(65) Prior Publication Data

US 2017/0217217 A1 Aug. 3, 2017

(30) Foreign Application Priority Data

Jan. 29, 2016 (JP) ..... 2016-016158

(51) Int. Cl.

| | |
|---|---|
| ***B41J 11/00*** | (2006.01) |
| ***B41J 2/01*** | (2006.01) |
| ***B41M 7/00*** | (2006.01) |
| ***B41M 5/00*** | (2006.01) |

(52) U.S. Cl.

CPC ..... *B41J 11/0015* (2013.01); *B41J 2/01* (2013.01); *B41M 5/0011* (2013.01); *B41M 5/0017* (2013.01); *B41M 7/00* (2013.01); *B41M 7/0045* (2013.01); *B41M 7/0054* (2013.01); *B41J 2002/012* (2013.01)

(58) Field of Classification Search

CPC ..... B41J 11/0015

See application file for complete search history.

(56) References Cited

U.S. PATENT DOCUMENTS

| | | | | |
|---|---|---|---|---|
| 9,566,781 | B2 | 2/2017 | Takeuchi et al. | |
| 2006/0066662 | A1* | 3/2006 | Kadomatsu | B41J 2/2114 347/21 |
| 2008/0074462 | A1* | 3/2008 | Hirakawa | B41J 2/0057 347/28 |
| 2009/0085960 | A1* | 4/2009 | Yahiro | B41J 2/2114 347/21 |
| 2009/0087565 | A1* | 4/2009 | Houjou | B41J 2/01 427/256 |
| 2009/0317555 | A1* | 12/2009 | Hori | B41J 2/0057 427/428.06 |

FOREIGN PATENT DOCUMENTS

| | | |
|---|---|---|
| JP | 2009-045851 A | 3/2009 |

* cited by examiner

*Primary Examiner* — Kristal Feggins
*Assistant Examiner* — Kendrick X Liu
(74) *Attorney, Agent, or Firm* — Venable LLP

(57) ABSTRACT

An ink jet recording method includes a step of forming a first image containing a first liquid and a coloring material on an ink receiving medium and a liquid absorbing step of bringing a liquid absorbing member including a porous body into contact with the first image to absorb at least some of the first liquid from the first image to form a second image.

16 Claims, 6 Drawing Sheets

INK JET RECORDING METHOD AND INK JET RECORDING APPARATUS

BACKGROUND OF THE INVENTION

Field of the Invention

The present invention relates to an ink jet recording method and an ink jet recording apparatus.

Description of the Related Art

In an ink jet recording method, a liquid composition containing a coloring material (ink) is directly or indirectly applied onto a recording medium such as paper to form an image. During the process, bleeding may be caused by mixing of inks applied adjacent to each other, and beading may be caused by pulling of a previously applied ink by a subsequently applied ink. In addition, a recording medium may excessively absorb the liquid component in an ink to cause curing or cockling.

In order to solve such problems, there are a method of drying a recording medium by using warm air, infrared light, or a similar technique and a method in which an image is formed on a transfer body, then a liquid component contained in the image on the transfer body is dried by thermal energy or the like, and the image is transferred to a recording medium such as paper.

Another method is disclosed as the technique of removing the liquid component contained in an image on a transfer body without using thermal energy. In the method, a roller-like porous body is brought into contact with an ink image to absorb and remove the liquid component from the ink image (Japanese Patent Application Laid-Open No. 2009-45851). Japanese Patent Application Laid-Open No. 2009-45851 also discloses a structure in which a liquid functioning to aggregate solvent-insoluble components (a coloring material, for example) in an ink is applied with an application roller onto a transfer body and then an ink is applied.

SUMMARY OF THE INVENTION

The present invention is directed to provide an ink jet recording method and an ink jet recording apparatus capable of stably absorbing a liquid component from images.

An aspect of the present invention provides an ink jet recording method including a step of forming a first image containing a first liquid and a coloring material on an ink receiving medium; and a liquid absorbing step of bringing a liquid absorbing member including a porous body into contact with the first image to allow the porous body to absorb at least some of the first liquid from the first image to form a second image, the step of forming a first image including a step of applying a first liquid composition containing the first liquid or a second liquid onto the ink receiving medium, and a step of applying a second liquid composition containing the first liquid or a second liquid, and the coloring material onto the ink receiving medium, at least one of the first liquid composition and the second liquid composition containing the first liquid, the ink jet recording method further comprising, before the liquid absorbing step, a step of applying a third liquid composition to at least a region to which the first liquid composition is applied but the second liquid composition is not applied, the third liquid composition containing no coloring material but containing at least a water-soluble resin and a water-soluble organic solvent, a mixture of the first liquid composition and the third liquid composition formed by applying the third liquid composition being more viscously thickened than the first liquid composition.

Another aspect of the present invention provides an ink jet recording apparatus including an image forming unit configured to form a first image containing a first liquid and a coloring material on an ink receiving medium; and a liquid absorbing member including a porous body configured to come into contact with the first image to absorb at least some of the first liquid from the first image to form a second image, the image forming unit including a device configured to apply a first liquid composition containing the first liquid or a second liquid onto the ink receiving medium, and a device configured to apply a second liquid composition containing the first liquid or a second liquid and the coloring material onto the ink receiving medium, at least one of the first liquid composition and the second liquid composition containing the first liquid, the ink jet recording apparatus further comprising a mechanism configured to apply, before the first image comes into contact with the liquid absorbing member, a third liquid composition to at least a region to which the first liquid composition is applied but the second liquid composition is not applied, the third liquid composition containing no coloring material but containing at least a water-soluble resin and a water-soluble organic solvent, a mixture of the first liquid composition and the third liquid composition being more viscously thickened than the first liquid composition.

Further features of the present invention will become apparent from the following description of exemplary embodiments with reference to the attached drawings.

BRIEF DESCRIPTION OF THE DRAWINGS

FIGS. 6A and 6B are reverse patterns to each other.

DESCRIPTION OF THE EMBODIMENTS

Figure 1:
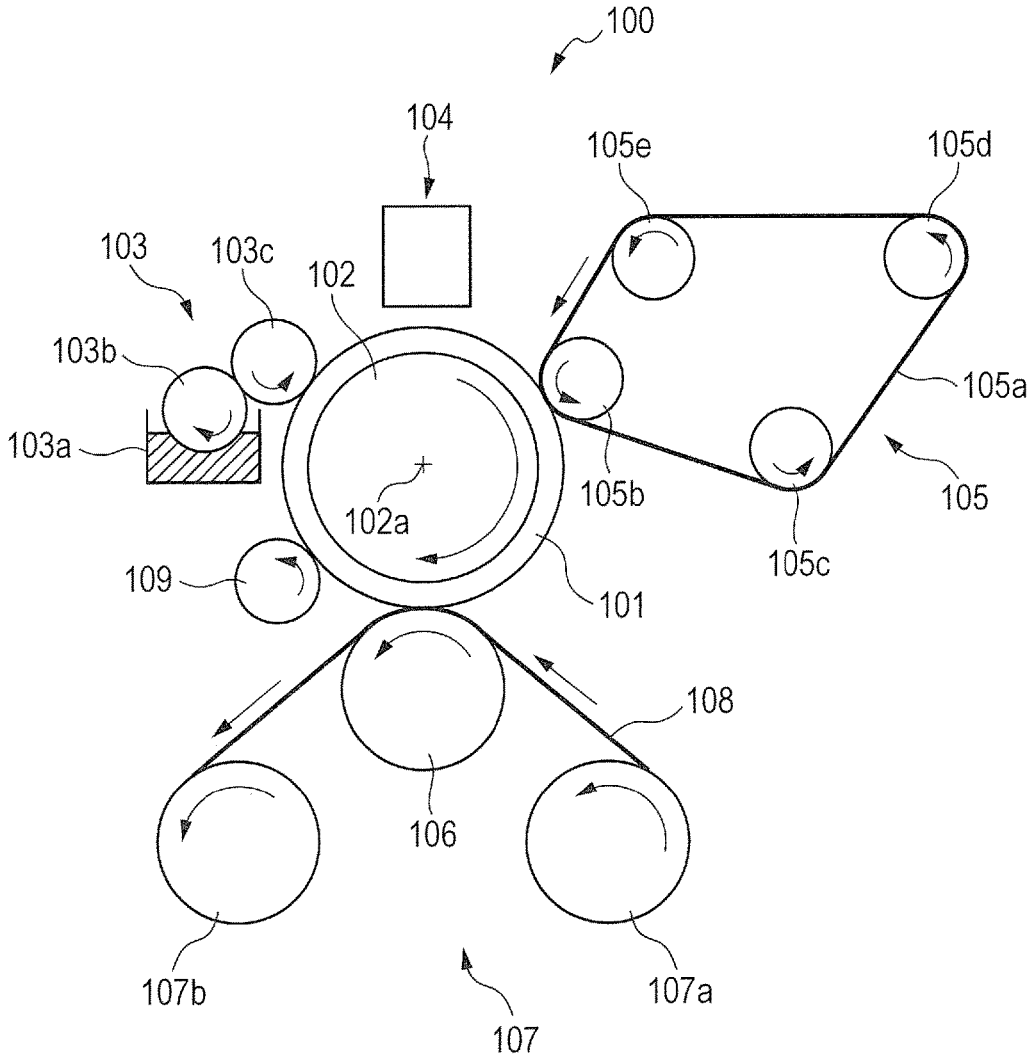
FIG. 1 is a schematic view showing an exemplary structure of a transfer type ink jet recording apparatus according to an embodiment of the present invention.

Preferred embodiments of the present invention will now be described in detail in accordance with the accompanying drawings.

When the liquid removal by contact of a liquid absorbing member including a porous body disclosed in Japanese Patent Application Laid-Open No. 2009-45851 is applied to an image on a transfer body, the liquid absorbing member comes into direct contact with not only an ink image region but also a non-ink image region, or a region to which only a liquid functioning to aggregate an ink is applied. A portion of the liquid absorbing member to which only the liquid functioning to aggregate an ink adheres is likely to clog, and the absorbability may deteriorate. In addition, when a surface of the liquid absorbing member that has absorbed only the liquid functioning to aggregate an ink comes into contact with an image, the viscosity of the portion increases, and a coloring material or the like may adhere to the liquid absorbing member. When a liquid absorbing member is repeatedly used, the liquid absorbing member can be subjected to cleaning, but it is difficult to completely remove adhering substances, and the repeatable liquid removal performance deteriorates. As a result of intensive studies for providing an ink jet recording apparatus and an ink jet recording method capable of stably absorbing a liquid component from images, the inventors of the present invention have completed the present invention.

An ink jet recording apparatus of the present invention includes an image forming unit configured to form a first image containing a first liquid and a coloring material on an ink receiving medium and a liquid absorbing member including a porous body configured to come into contact with the first image to absorb at least some of the first liquid from the first image. By bringing the liquid absorbing member including the porous body into contact with the first image containing a first liquid and a coloring material on an ink receiving medium, at least some of the first liquid is removed from the first image. This prevents a recording medium such as paper from excessively absorbing the first liquid in the first image, thereby suppressing curing or cockling.

In the ink jet recording apparatus of the present invention, the image forming unit may be any image forming unit that enables the formation of a first image containing a first liquid and a coloring material on an ink receiving medium. Preferred is an image forming unit that includes 1) a device of applying a first liquid composition containing the first liquid or a second liquid, and an ink-viscosity-increasing component onto an ink receiving medium and 2) a device of applying a second liquid composition containing the first liquid or a second liquid and the coloring material onto the ink receiving medium and forms a first image as a mixture of the first and second liquid compositions. Typically, the second liquid composition is an ink containing a coloring material, and the device of applying the second liquid composition onto the ink receiving medium is an ink jet recording device. The first liquid composition contains a component (ink-viscosity-increasing component) that chemically or physically interacts with the second liquid composition to viscously thicken a mixture of the first and second liquid compositions as compared with each of the first and second liquid compositions. At least one of the first and second liquid compositions contains the first liquid. Here, the first liquid contains a liquid having a low volatility at normal temperature (room temperature) and especially contains water. The second liquid is a liquid other than the first liquid, and may have any volatility, but is preferably a liquid having a higher volatility than that of the first liquid. The arrangement of the apparatus that applies the first liquid composition onto the ink receiving medium and the apparatus that applies the second liquid composition onto the ink receiving medium within the ink jet recording apparatus is not specifically limited. However, from the point of view of obtaining an image with higher image quality, it is preferable to undergo a step of applying the first liquid composition onto the ink receiving medium and then a step of applying the second liquid composition onto the ink receiving medium such that the second liquid composition overlaps with at least a part of a region on which the first liquid composition has been applied. Consequently, it is preferable that the apparatus that applies the first liquid composition onto the ink receiving medium and the apparatus that applies the second liquid composition onto the ink receiving medium are arranged so as to make it possible to apply the first liquid composition onto the ink receiving medium and apply the second liquid composition onto the ink receiving medium such that the second liquid composition overlaps with at least a part of a region on which the first liquid composition has been applied. Hereinafter, the first liquid composition is also called "reaction liquid", and the device of applying the first liquid composition onto the ink receiving medium is also called "reaction liquid applying device". The second liquid composition is also called "ink", and the device of applying the second liquid composition onto the ink receiving medium is also called "ink applying device". The first image is an ink image before the liquid removal in the liquid absorbing treatment, and the second image is an ink image after the liquid removal by the liquid absorbing treatment to reduce the content of the liquid component.

The ink jet recording method of the present invention is characterized by applying, before liquid removal by contact of a liquid absorbing member, a treatment liquid containing no coloring material but containing at least a water-soluble resin and a water-soluble organic solvent (also called "third liquid composition") to at least a region to which the first liquid composition (reaction liquid) is applied but the second liquid composition (ink) is not applied (non-ink image region) on the ink receiving medium, or a region on which only the first liquid composition (reaction liquid) can be left on the ink receiving medium without reaction with the second liquid composition. A mixture of the first liquid composition and the treatment liquid formed by application of the treatment liquid is more viscously thickened than the first liquid composition. When the treatment liquid is applied, before the liquid removal by contact of a liquid absorbing member, to a non-ink image region, or a region with only the reaction liquid, the water-soluble resin contained in the treatment liquid is chemically reacted with polyvalent metal ions, an organic acid, or the like contained in the reaction liquid, thus the non-ink image region becomes in a highly viscous state (viscously thickened state) as with the ink image region, and this suppresses the reaction liquid adhesion to the liquid absorbing member. By applying the water-soluble organic solvent, a highly viscous agglomerate composed of the water-soluble resin and the reaction liquid is prevented from drying, and thus the reaction liquid adhesion to the liquid absorbing member is thought to be more effectively suppressed. As a result, even when the liquid absorbing member is repeatedly used, the liquid component can be stably absorbed from images. With the above mentioned structure, an ink jet recording method and an ink jet recording apparatus achieving smaller energy consumption as compared with heat drying can be produced.

<Reaction Liquid Applying Device>

The reaction liquid applying device may be any device capable of applying a reaction liquid onto an ink receiving medium, and conventionally known various devices can be appropriately used. Specific examples of the device include a gravure offset roller, an ink jet head, a die coating device (die coater), and a blade coating device (blade coater). The application of a reaction liquid by the reaction liquid applying device may be performed either before the application of an ink or after the application of an ink as long as the reaction liquid can be mixed (reacted) with an ink on an ink receiving medium. Preferably, the reaction liquid is applied before the application of an ink. The application of a reaction liquid before the application of an ink enables suppression of bleeding, which is caused by mixing of inks applied adjacent to each other, or beading, which is caused by pulling of a previously applied ink by a subsequently applied ink at the time of image recording by the ink jet system.

<Reaction Liquid>

The reaction liquid contains a component that increases the viscosity of an ink (ink-viscosity-increasing component). Here, the increase in viscosity of an ink is such a phenomenon that when a coloring material, a resin, or the like as a component constituting an ink comes into contact with an ink-viscosity-increasing component, the components are chemically reacted or physically adsorbed, and this causes an increase in viscosity of the whole ink. The increase in viscosity of an ink includes not only the case in which an increase in viscosity of an ink can be observed but also the case in which the viscosity is locally increased by aggregation of some of the components constituting an ink, such as a coloring material and a resin.

The ink-viscosity-increasing component has the effect of lowering the flowability of an ink and/or some of the components constituting an ink on an ink receiving medium to suppress bleeding or beading at the time of first image formation. In the present invention, increasing the viscosity of an ink is also called "viscously thickening an ink". As such an ink-viscosity-increasing component, polyvalent metal ions, organic acids, cation polymers, porous microparticles, and other known materials can be used. Specifically preferred are polyvalent metal ions and organic acids. A plurality of types of ink-viscosity-increasing components can also be preferably contained. The content of the ink-viscosity-increasing component in the reaction liquid is preferably 5% by mass or more relative to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid can contain water or a low volatile organic solvent in an appropriate amount as the first liquid. The water used in this case is preferably a deionized water prepared by ion exchanging, for example. The organic solvent used in the reaction liquid to be applied to the present invention is not limited to particular solvents, and a known organic solvent can be used.

To the reaction liquid, a surfactant or a viscosity modifier can be added to appropriately adjust the surface tension or the viscosity thereof, and such a reaction liquid can be used. The material to be used may be any material that can coexist with the ink-viscosity-increasing component. The surfactant specifically used is exemplified by an acetylene glycol ethylene oxide adduct ("Acetylenol E100", trade name manufactured by Kawaken Fine Chemicals) and a perfluoroalkyl ethylene oxide adduct ("MEGAFACE F444", trade name manufactured by DIC Corporation).

<Ink Applying Device>

As the ink applying device for applying an ink, an ink jet head is used. The ink jet head is exemplified by a device that causes film boiling of an ink by an electrothermal converter to form bubbles and discharges the ink, a device that discharges an ink by an electromechanical converter, and a device that discharges an ink by using static electricity. In the present invention, a known ink jet head can be used. Of them, the device using an electrothermal converter can be suitably used, particularly from the viewpoint of high-density printing at high speed. To record an image, the head applies an intended amount of an ink to an intended position upon receiving an image signal.

The ink application amount can be expressed by image density (duty) or ink thickness. In the present invention, the mass of each ink dot is multiplied by the number of dots applied, and the result is divided by a printed area to give an average as the ink application amount ($g/m^2$). The maximum ink application amount in an image region represents an ink application amount in an area of at least 5 $mm^2$ or more within a region used as information of an ink receiving medium from the viewpoint of removing the liquid component in an ink.

The ink jet recording apparatus of the present invention can include a plurality of ink jet heads in order to apply various color inks on an ink receiving medium. For example, when a yellow ink, a magenta ink, a cyan ink, and a black ink are used to form a four-color image, the ink jet recording apparatus includes four ink jet heads that each discharges a corresponding ink of the four inks on an ink receiving medium. The ink applying device may further includes an ink jet head that discharges an ink containing no coloring material (clear ink).

<Ink>

Each component of the ink applied to the present invention will be described.

(Coloring Material)

As the coloring material contained in the ink applied to the present invention, preferably contains a pigment. For example, the pigment or a mixture of a dye and the pigment can be used as the coloring material. The pigment usable as the coloring material is not limited to particular types. Specific examples of the pigment include inorganic pigments such as carbon black; and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more of them as needed.

The dye usable as the coloring material is not limited to particular types. Specific examples of the dye include direct dyes, acid dyes, basic dyes, disperse dyes, and food dyes, and a dye having an anionic group can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass or more to 15.0% by mass or less and more preferably 1.0% by mass or more to 10.0% by mass or less relative to the total mass of the ink.

(Dispersant)

As the dispersant for dispersing a pigment, a known dispersant used in an ink jet ink can be used. Specifically, a water-soluble dispersant having both a hydrophilic moiety and a hydrophobic moiety in the structure is preferably used in an embodiment of the present invention. In particular, a pigment dispersant composed of a resin prepared by copolymerizing a mixture containing at least a hydrophilic monomer and a hydrophobic monomer is preferably used. Each monomer used here is not limited to particular monomers, and known monomers are suitably used. Specifically, examples of the hydrophobic monomer include styrene and other styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more to 550 mg KOH/g or less. The dispersant preferably has a weight average molecular weight of 1,000 or more to 50,000 or less. The mass ratio of the pigment and the dispersant (pigment:dispersant) is preferably in a range of 1:0.1 to 1:3.

What is called a self-dispersible pigment that is dispersible due to surface modification of a pigment itself and eliminates the use of the dispersant is also preferably used in the present invention.

(Resin Microparticles)

The ink applied to the present invention can contain various microparticles with no coloring material, and such an ink can be used. Specifically, resin microparticles may have the effect of improving image quality or fixability and are preferred. The material of the resin microparticles usable in the present invention is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylate, and polydiene; and copolymers prepared by copolymerizing a plurality of monomers, which are used for forming such a homopolymer, in combination. The resin preferably has a weight average molecular weight (Mw) of 1,000 or more to 2,000,000 or less. In the ink, the content of the resin microparticles is preferably 1% by mass or more to 50% by mass or less and more preferably 2% by mass or more to 40% by mass or less relative to the total mass of the ink.

In an embodiment of the present invention, the resin microparticles are preferably used as a resin microparticle dispersion in which the resin microparticles are dispersed in a liquid. The dispersion technique is not limited to particular techniques. Preferred is what is called a self-dispersion type resin microparticle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, what is called an emulsion-dispersion type resin microparticle dispersion in which resin microparticles are dispersed with an emulsifier can be similarly, suitably used in the present invention. As the emulsifier as used herein, a known surfactant is preferred regardless of having a low molecular weight or a high molecular weight. The surfactant is preferably a nonionic surfactant or a surfactant having the same charge polarity as that of resin microparticles.

The resin microparticle dispersion used in an embodiment of the present invention preferably has a dispersion particle diameter of 10 nm or more to 1,000 nm or less, more preferably 50 nm or more to 500 nm or less, and much more preferably has 100 nm or more to 500 nm or less.

When the resin microparticle dispersion used in an embodiment of the present invention is prepared, various additives are preferably added for stabilization. Examples of the additive include n-hexadecane, dodecyl methacrylate, stearyl methacrylate, chlorobenzene, dodecyl mercaptan, a blue dye (bluing agent), and polymethyl methacrylate.

(Curing Component)

In the present invention, either the reaction liquid or the ink preferably contains a component that is cured by active energy rays. By curing a component curable by active energy rays before the liquid absorbing step, the coloring material adhesion to a liquid absorbing member may be suppressed.

As the component curable by active energy rays used in the present invention, a component cured by active energy ray irradiation to have a lower solubility than that before irradiation is used. For example, a typical ultraviolet curable resin can be used. Although many ultraviolet curable resins are insoluble in water, the material applicable to an aqueous ink preferably used in the present invention preferably has, in the structure thereof, at least an ethylenically unsaturated bond curable by ultraviolet light and has a hydrophilic bonding group. The bonding group for giving hydrophilicity is exemplified by a hydroxy group, a carboxyl group, a phosphoric acid group, a sulfonic acid group, salts thereof, an ether bond, and an amide bond.

The curable component used in the present invention preferably has hydrophilicity.

The active energy rays are exemplified by ultraviolet light, infrared light, and an electron beam.

In the present invention, either the reaction liquid or the ink preferably contains a polymerization initiator. The polymerization initiator used in the present invention may be any compound that generates radicals by active energy rays.

In an extremely preferred embodiment, a sensitizing agent functioning to widen a light absorption wavelength range in order to increase a reaction rate is used in combination.

(Surfactant)

The ink usable in the present invention may contain a surfactant. The surfactant is specifically exemplified by an acetylene glycol ethylene oxide adduct (Acetylenol E100, manufactured by Kawaken Fine Chemicals). In the ink, the content of the surfactant is preferably 0.01% by mass or more to 5.0% by mass or less relative to the total mass of the ink.

(Water and Water-Soluble Organic Solvent)

The ink used in the present invention can contain water and/or a water-soluble organic solvent as the solvent. The water is preferably a deionized water prepared by ion exchanging, for example. In the ink, the content of the water is preferably 30% by mass or more to 97% by mass or less relative to the total mass of the ink, and is more preferably 50% by mass or more to 95% by mass or less relative to the total mass of the ink.

The water-soluble organic solvent to be used is not limited to particular types, and any known organic solvent can be used. Specific examples of the water-soluble organic solvent include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more solvents selected from these solvents can be used as a mixture.

In the ink, the content of the water-soluble organic solvent is preferably 3% by mass or more to 70% by mass or less relative to the total mass of the ink.

(Other Additives)

The ink usable in the present invention may contain, in addition to the above components, various additives such as a pH adjuster, an anticorrosive, an antiseptic agent, an antifungal agent, an antioxidant, a reduction inhibitor, a water-soluble resin and a neutralizer thereof, and a viscosity modifier, as needed.

<Treatment Liquid>

The present invention is characterized by applying a third liquid composition (treatment liquid) to at least a region to which the first liquid composition (reaction liquid) is applied but the second liquid composition (ink) is not applied (non-ink image region), or a region to which only the first liquid composition (reaction liquid) is applied. The non-ink image region means a region including an image marginal part to which an ink is not applied. The treatment liquid used in the present invention contains no coloring material but contains at least a water-soluble resin and a water-soluble organic solvent. As other components, various materials usable in the ink other than the coloring material can be used. What is called a clear ink prepared by removing the coloring material from the ink can be used as long as a water-soluble resin and a water-soluble organic solvent are contained. A mixture of the first liquid composition and the treatment liquid formed by application of the treatment liquid is more viscously thickened than the first liquid composition.

(Water-Soluble Resin)

The water-soluble resin preferably has both a hydrophilic moiety and a hydrophobic moiety. Specific examples include acrylic resins prepared by polymerization of a monomer having a carboxyl group, such as acrylic acid and methacrylic acid; and urethane resins prepared by polymerization of a diol having an anionic group, such as dimethylolpropionic acid. The content of the water-soluble resin in the treatment liquid is preferably 0.5% by mass or more to 15% by mass or less and more preferably 1% by mass or more to 5% by mass or less relative to the total mass of the treatment liquid.

The water-soluble resin preferably has an acid value of 50 mg KOH/g or more to 300 mg KOH/g or less. The water-soluble resin preferably has a weight average molecular weight (Mw) of 1,000 or more to 30,000 or less in terms of polystyrene determined by gel permeation chromatography (GPC).

(Water-Soluble Organic Solvent)

The water-soluble organic solvent is not limited to particular types, and any known organic solvent can be used. Specific examples include glycerol, diethylene glycol, polyethylene glycol, 2-pyrrolidone, ethanol, and methanol. The content of the water-soluble organic solvent in the treatment liquid is preferably 3% by mass or more to 70% by mass or less and more preferably 5% by mass or more to 20% by mass or less relative to the total mass of the treatment liquid.

In the present invention, when the treatment liquid is applied to a non-ink image region, the treatment liquid is preferably applied in such a manner that the application amount of the water-soluble organic solvent contained in the treatment liquid will be 0.3 $g/m^2$ or more to 1.2 $g/m^2$ or less. The treatment liquid is more preferably applied in such a manner that the application amount of the water-soluble organic solvent will be 0.36 $g/m^2$ or more to 0.8 $g/m^2$ or less. When the application amount of the water-soluble organic solvent is within the range, the reaction liquid adhesion to the liquid absorbing member can be more effectively suppressed.

The treatment liquid (the third liquid composition) pertaining to the present invention is applied to at least the non-ink image region and may be applied to the ink image region to which the second liquid composition (ink) is applied in the first image. The treatment liquid can be applied by an application mechanism capable of controlling the application amount as mentioned above, and a device similar to the above reaction liquid applying device or the ink applying device can be used. In other words, the ink jet recording apparatus pertaining to the present invention includes a treatment liquid and includes a mechanism for applying, before the first image comes into contact with the liquid absorbing member, the treatment liquid to at least a region to which the first liquid composition is applied but the second liquid composition is not applied. In particular, the ink applying device may be equipped with an ink jet head for applying the treatment liquid in addition to the ink jet heads for applying various color inks. The treatment liquid can be applied at any time before the first image comes into contact with the liquid absorbing member and can be applied before the application of the first liquid composition (reaction liquid) or before the application of the second liquid composition (ink). The treatment liquid is preferably applied after the application of the first liquid composition (reaction liquid) and the second liquid composition (ink). It is particularly preferred that the first liquid composition (reaction liquid) be applied, subsequently the second liquid composition (ink) be applied, and then the treatment liquid be applied.

<Liquid Absorbing Member>

The present invention includes a liquid absorbing step in which a liquid absorbing member including a porous body is brought into contact with the first image formed from a highly viscous ink on the transfer body to absorb at least some of the first liquid, thus the content of a liquid component in the first image is reduced, and a second image is formed. The contact surface of the liquid absorbing member with the first image is regarded as a first face, and the porous body is placed on the first face. Such a liquid absorbing member including the porous body preferably moves as the ink receiving medium moves, and preferably has such a shape that the liquid absorbing member rotates at a certain cycle after coming into contact with a first image, to come into contact with another first image and can absorb a liquid. The shape is exemplified by an endless-belt shape and a drum shape. The removal of the liquid component from an image by the liquid absorbing member enables suppression of image disturbances such as curing, cockling, and offset to a stacked paper caused by a remaining liquid component contained in an image, after transfer to a recording medium such as paper.

In the present invention, the treatment liquid is applied to a non-ink image region before the liquid absorbing step, and thus the reaction liquid adhesion to the liquid absorbing member is suppressed. As a result, even when the liquid absorbing member is repeatedly used, the liquid component can be stably absorbed from images.

(Porous Body)

Porous body and method for producing porous body will be described below. In the present invention, the porous body has only to be a material having numerous pores. The porous body of the present invention includes a material having numerous pores formed by mutual crossing of fibers, for example. The porous body of the liquid absorbing member pertaining to the present invention preferably has a smaller average pore diameter on the first face than the average pore diameter on a second face opposite to the first face. In order to suppress the ink coloring material adhesion to the porous body, the pore diameter is preferably small, and at least the porous body on the first face that comes into contact with an image preferably has an average pore diameter of 10 μm or less. In the present invention, the average pore diameter means an average diameter on the surface of the first face or the second face, and can be determined by a known technique such as a mercury intrusion method, a nitrogen adsorption method, and SEM image observation.

In order to evenly achieve high breathability, the porous body preferably has a small thickness. The breathability can be expressed as Gurley value in accordance with JIS P8117, and the Gurley value is preferably 10 seconds or less. A thin porous body, however, cannot ensure a capacity sufficient to absorb a liquid component in some cases, and thus the porous body can have a multilayer structure. In the liquid absorbing member, only the layer to come into contact with the first image is required to be a porous body, and a layer not to come into contact with the first image is not necessarily a porous body.

Next, an embodiment in which the porous body has a multilayer structure will be described. In this explanation, the layer on the side to come into contact with the first image is a first layer, and the layer laminated on the face opposite to the contact surface of the first layer with the first image is a second layer. For a structure including three or more layers, the layers are expressed in the laminating order successively from the first layer. In the present specification, the first layer is also called "absorbing layer", and the second and subsequent layers are also called "support layer".

[First Layer]

In the present invention, the first layer may be made of any material, and any of the hydrophilic materials having a contact angle with water of less than 90° and the water-repellent materials having a contact angle with water of 90° or more can be used. When used, the hydrophilic material preferably has a contact angle with water of 60° or less. The hydrophilic material has the effect of sucking a liquid by capillary force.

The hydrophilic material is preferably selected from raw materials such as cellulose and polyacrylamide, and composite materials of them, for example. The surface of the water-repellent materials mentioned below can be subjected to hydrophilization treatment, and a resulting material can be used as the hydrophilic material. The hydrophilization treatment is performed by a method such as sputter etching, radiation exposure, $H_2O$ ion exposure, excimer (ultraviolet) laser beam irradiation.

In order to suppress coloring material adhesion and to improve cleanability, the material of the first layer is preferably a water-repellent material having a low surface free energy, specifically a fluororesin. The fluororesin is specifically exemplified by polytetrafluoroethylene (hereinafter PTFE), polychlorotrifluoroethylene (PCTFE), polyvinylidene fluoride (PVDF), polyvinyl fluoride (PVF), perfluoroalkoxy fluororesin (PFA), a tetrafluoroethylene/hexafluoropropylene copolymer (FEP), an ethylene/tetrafluoroethylene copolymer (ETFE), and an ethylene/chlorotrifluoroethylene copolymer (ECTFE). These resins can be used singly or in combination of two or more of them as needed. A plurality of films may be laminated in the first layer. A water-repellent material has almost no function of sucking a liquid component by capillary force, and may take time to suck a liquid when coming into contact with an image for the first time. On this account, the first layer is preferably impregnated with a liquid having a contact angle with the first layer of less than 90°. In contrast to the first liquid and an optional second liquid in the first image, the liquid that is infiltrated into the first layer is also called third liquid. The third liquid can be applied onto the first face of the liquid absorbing member to be infiltrated into the first layer. The third liquid is preferably prepared by mixing the first liquid (water) with a surfactant or a liquid having a low contact angle with the first layer.

In the present invention, the first layer preferably has a film thickness of 50 μm or less. The film thickness is more preferably 30 μm or less. In examples of the present invention, the film thickness was determined by measuring film thicknesses at any 10 points with a linear micrometer, OMV-25 (manufactured by Mitutoyo) and calculating the average.

The first layer can be produced by a known method for producing a thin porous film. For example, a resin material can be subjected to extrusion molding or a similar technique to give a sheet-like material, and the sheet-like material can be drawn into an intended thickness, yielding a first layer. Alternatively, a plasticizer such as paraffin can be added to the material for extrusion molding, and the plasticizer can be removed, for example, by heating at the time of drawing, yielding a porous film. The pore diameter can be adjusted by appropriately controlling the amount of a plasticizer added, the draw ratio, and the like.

[Second Layer]

In the present invention, the second layer is preferably a layer having breathability. Such a layer can be either a nonwoven fabric or a woven fabric of resin fibers. The second layer may be made of any material. In order to prevent the liquid absorbed by the first layer from flowing back, the material preferably has a contact angle with the first liquid equal to or lower than that of the first layer. Specifically, the material is preferably selected from raw materials such as polyolefins (including polyethylene (PE) and polypropylene (PP)), polyurethanes, polyamides such as nylon, polyesters (including polyethylene terephthalate (PET)), and polysulfone (PSF), and composite materials of them, for example. The second layer is preferably a layer having a larger pore diameter than that of the first layer.

[Third Layer]

In the present invention, the porous body having a multilayer structure may include three or more layers and is not limited. The third and subsequent layers are preferably a nonwoven fabric from the viewpoint of rigidity. As the material, a similar material to that for the second layer can be used.

[Other Materials]

The liquid absorbing member may include, in addition to the porous body having a multilayer structure, a reinforcing member that reinforces side faces of the liquid absorbing member. The liquid absorbing member may also include a joining member that joins the longitudinal ends of a long sheet-like porous body to form a belt-like member. For example, a non-porous tape material can be used as such a material and can be placed at a position or a cycle with which images do not come into contact.

[Production Method of Porous Body]

The method of laminating the first layer and the second layer to form the porous body may be any method. The layers can be simply laminated or can be bonded to each other by a technique such as lamination by an adhesive agent or lamination by heating. From the viewpoint of breathability, lamination by heating is preferred in the present invention. Alternatively, the first layer or the second layer may be partly melted by heat, for example, and the layers may be adhesively laminated. A fusing material such as a hot melt powder may be interposed between the first layer and the second layer, and the layers may be adhesively laminated by heating. When a third or subsequent layer is laminated, layers may be laminated at once, or may be laminated successively. The lamination order is appropriately selected.

In the heating step, preferred is a lamination method in which porous bodies are heated while the porous bodies are interposed between heated rollers and pressed.

(Liquid Removal Method from Liquid Absorbing Member)

The liquid component absorbed from images by the liquid absorbing member can be removed from the liquid absorbing member by a known technique. The technique is exemplified by a heating method, a method of blowing air with low humidity, a decompression method, and a method of squeezing a porous body.

Next, a specific embodiment of the ink jet recording apparatus of the present invention will be described.

The ink jet recording apparatus of the present invention includes an ink jet recording apparatus in which a first image is formed on a transfer body as the ink receiving medium and a second image after absorption of a first liquid by a liquid absorbing member is transferred onto a recording medium and an ink jet recording apparatus in which a first image is formed on a recording medium as the ink receiving medium. In the present invention, the former ink jet recording apparatus is called transfer type ink jet recording apparatus for convenience hereinafter, and the latter ink jet recording apparatus is called direct drawing type ink jet recording apparatus for convenience hereinafter.

Each ink jet recording apparatus will next be described.

<Transfer Type Ink Jet Recording Apparatus>

FIG. 1 is a schematic view showing an exemplary schematic structure of a transfer type ink jet recording apparatus of the embodiment.

The transfer type ink jet recording apparatus 100 includes a transfer body 101 for temporarily holding a first image and a second image formed by absorbing at least some of a first liquid from the first image. The transfer type ink jet recording apparatus 100 further includes a transfer unit including a pressing member for transferring 106 that transfers the second image onto a recording medium 108 on which an image is to be formed, or onto a recording medium for forming a final image depending on an intended purpose.

The transfer type ink jet recording apparatus 100 of the present invention includes the transfer body 101 supported by a support member 102, a reaction liquid applying device 103 for applying a reaction liquid onto the transfer body 101, an ink applying device 104 for applying an ink onto the transfer body 101 with the reaction liquid to form an ink image (first image) on the transfer body, a liquid absorbing device 105 for absorbing a liquid component from the first image on the transfer body, and the pressing member for transferring 106 for pressing a recording medium to transfer a second image from which the liquid component has been removed, on the transfer body onto the recording medium 108 such as paper. The transfer type ink jet recording apparatus 100 may further include a cleaning member 109 for a transfer body configured to clean the surface of the transfer body 101 after the second image has been transferred to the recording medium, as necessary.

The support member 102 rotates around a rotating shaft 102*a* as the center in the arrow direction in FIG. 1. By rotating the support member 102, the transfer body 101 moves in the direction indicated by the arrow. On the moving transfer body 101, a reaction liquid and an ink are sequentially applied by the reaction liquid applying device 103 and the ink applying device 104, respectively, and a first image is formed on the transfer body 101. As the transfer body 101 moves, the first image formed on the transfer body 101 moves to the position at which a liquid absorbing member 105*a* of the liquid absorbing device 105 comes into contact.

The liquid absorbing member 105*a* of the liquid absorbing device 105 synchronizes with the rotation of the transfer body 101. The first image formed on the transfer body 101 undergoes the state of contact with the moving liquid absorbing member 105*a*. During the contact state, the liquid absorbing member 105*a* removes a liquid component containing at least an aqueous liquid component from the first image. By subjecting the first image to the state of contact with the liquid absorbing member 105*a*, the liquid component contained in the first image is removed. In a preferred structure, the liquid absorbing member 105*a* is in pressure contact with the first image at a certain pressing force for helping the liquid absorbing member 105*a* to function effectively in the state of contact.

The removal of the liquid component can be expressed from a different point of view as concentrating the ink (liquid composition containing a coloring material) constituting the first image formed on the transfer body. Concentrating the ink means that the proportion of the solid content contained in the ink, such as coloring material and resin, with respect to the liquid component contained in the ink increases owing to reduction in the liquid component.

As the transfer body 101 moves, the second image formed by removal of the liquid component from the first image moves to a transfer unit at which the second image comes into contact with a recording medium 108 conveyed by a recording medium conveyance device 107. While the second image from which the liquid component has been removed is in contact with the recording medium 108, pressing by the pressing member 106 against the recording medium 108 allows the ink image to be formed on the recording medium 108. The ink image after transfer onto the recording medium 108 is a reverse image of the second image. In the following description, the ink image after transfer is also called third image, separately from the first image (ink image before liquid removal) and the second image (ink image after liquid removal) described above.

On the transfer body, the reaction liquid is applied, and then the ink is applied to form the first image. Thus, the reaction liquid is not reacted with the ink and is left in a non-image region (no ink image formation region). In the apparatus, the liquid absorbing member 105*a* comes into contact (pressure contact) with not only the first image but also the unreacted reaction liquid and removes also a liquid component in the reaction liquid from the surface of the transfer body 101.

Although the above description expresses that the liquid component is removed from the first image, the expression is not limited to removal of the liquid component only from the first image, but means that the liquid component is removed at least from the first image on the transfer body. For example, the liquid component in the reaction liquid applied to a region outside the first image can be removed together from the first image. The liquid component may be any liquid component that does not have a certain shape and have flowability and a substantially constant volume. The liquid component is exemplified by water and an organic solvent contained in an ink or a reaction liquid.

In a case where the clear ink is included in the first image, the ink can also be concentrated by a liquid absorbing process (liquid absorption treatment). For example, in a case where the clear ink is applied onto that color ink applied on the transfer body 101 which includes a coloring material, the clear ink is present over the entire surface of the first image or the clear ink is partially present at a position or a plurality of positions on the surface of the first image, and the color ink is present on the other positions of the surface of the first image. At the position of the first image where the clear ink is present over the color ink, the porous body absorbs liquid components of the clear ink on the surface of the first image, and thus the liquid components of the clear ink moves. Accordingly, liquid components in the color ink move to the porous body so that aqueous liquid components in the color ink are absorbed. On the other hand, at a position where both a region of the clear ink and a region of the color ink are present on the surface of the first image, liquid components of the color ink and the clear ink move to the porous body so that aqueous liquid components are absorbed. The clear ink may include a large amount of components for enhancing transferability of an image from the transfer body 101 to the recording medium. For example, the clear ink may include a large amount of a component whose adhesiveness to the recording medium is higher than adhesiveness of the color ink when heated.

Components constituting the transfer type ink jet recording apparatus of the embodiment will next be described.

(Transfer Body)

The transfer body 101 includes a surface layer having an image formation surface. As the material for the surface layer, various materials such as resins and ceramics can be appropriately used, but a material having a high compressive elastic modulus is preferred from the viewpoint of durability and the like. Specifically exemplified are an acrylic resin, an acrylic silicone resin, a fluorine-containing resin, and a condensate prepared by condensation of a hydrolyzable organic silicon compound. In order to improve the wettability of a reaction liquid, transferability, and the like, surface treatment may be performed. The surface treatment is exemplified by flame treatment, corona treatment, plasma treatment, polishing treatment, roughening treatment, active energy ray-irradiation treatment, ozone treatment, surfactant treatment, and silane coupling treatment. These treatments may be performed in combination. Any surface shape may be provided on the surface layer.

The transfer body preferably includes a compressible layer having such a function as to absorb pressure fluctuations. A provided compressible layer absorbs deformation to disperse local pressure fluctuations, and satisfactory transferability can be maintained even during high speed printing. The material for the compressible layer is exemplified by acrylonitrile-butadiene rubber, acrylic rubber, chloroprene rubber, urethane rubber, and silicone rubber. It is preferred that when such a rubber material is molded, predetermined amounts of a vulcanizing agent, a vulcanization accelerator, and the like be added, and a foaming agent, hollow microparticles, or a filler such as sodium chloride be further added as needed to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer body preferably further includes an elastic layer between the surface layer and the compressible layer. As the material for the elastic layer, various materials such as resins and ceramics can be appropriately used. From the viewpoint of processing characteristics and the like, various elastomer materials and rubber materials are preferably used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers, and nitrile-butadiene rubber. Specifically, silicone rubber, fluorosilicone rubber, and phenylsilicone rubber, which have a small compress set, are preferred from the viewpoint of dimensional stability and durability. The temperature change in elastic modulus of such a material is small, and thus the above materials are preferred from the viewpoint of transferability.

Between the layers constituting the transfer body (the surface layer, the elastic layer, and the compressible layer), various adhesives or double-sided adhesive tapes may be interposed in order to fix/hold the layers. The transfer body may also include a reinforcing layer having a high compressive elastic modulus in order to suppress lateral elongation when installed in an apparatus or to maintain resilience. A woven fabric may be used as the reinforcing layer. The transfer body can be prepared by combination of any layers made from the above materials.

The size of the transfer body can be freely selected depending on the size of an intended print image. The shape of the transfer body may be any shape and is specifically exemplified by a sheet shape, a roller shape, a belt shape, and an endless web shape.

(Support Member)

The transfer body 101 is supported on a support member 102. As the supporting manner of the transfer body, various adhesives or double-sided adhesive tapes may be used. Alternatively, by attaching an installing member made from a metal, ceramics, a resin, or the like to the transfer body, the transfer body may be supported on the support member 102 by using the installing member.

The support member 102 is required to have a certain structural strength from the viewpoint of conveyance accuracy and durability. As the material for the support member, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. It is also preferred to use these materials in combination.

(Reaction Liquid Applying Device)

The ink jet recording apparatus of the embodiment includes a reaction liquid applying device 103 for applying a reaction liquid onto the transfer body 101. The reaction liquid applying device 103 in FIG. 1 shows the case of a gravure offset roller including a reaction liquid storage unit 103*a* for storing a reaction liquid and reaction liquid applying members 103*b*, 103*c* for applying the reaction liquid in the reaction liquid storage unit 103*a* onto the transfer body 101.

(Ink Applying Device)

The ink jet recording apparatus of the embodiment includes an ink applying device 104 for applying an ink onto the transfer body 101 onto which the reaction liquid has been applied. The reaction liquid and the ink are mixed to form a first image, and a liquid component is absorbed from the first image by the subsequent liquid absorbing device 105.

(Liquid Absorbing Device)

In the present embodiment, the liquid absorbing device 105 includes a liquid absorbing member 105*a* and a pressing member 105*b* for liquid absorption for pressing the liquid absorbing member 105*a* against a first image on the transfer body 101. The liquid absorbing member 105*a* and the pressing member 105*b* may have any shape. Such a configuration as shown in FIG. 1 is exemplified. In the configuration, the pressing member 105*b* has a column shape, the liquid absorbing member 105*a* has a belt shape, and the column-like pressing member 105*b* presses the belt-like liquid absorbing member 105*a* against the transfer body 101. In another exemplified configuration, the pressing member 105*b* has a column shape, the liquid absorbing member 105*a* has a hollow column shape formed on the peripheral surface of the pressing member 105*b*, and the column-like pressing member 105*b* presses the hollow column-like liquid absorbing member 105*a* against the transfer body.

In the present invention, the liquid absorbing member 105*a* preferably has a belt shape in consideration of the space in the ink jet recording apparatus, for example. The liquid absorbing device 105 including such a belt-like liquid absorbing member 105*a* may also include extending members for extending the liquid absorbing member 105*a*. In FIGS. 1, 105*c*, 105*d*, and 105*e* are extending rollers as the extending members. In FIG. 1, the pressing member 105*b* is also a roller member rotating as with the extending rollers, but is not limited to this.

In the liquid absorbing device 105, The liquid absorbing member 105*a* including a porous body is brought into contact with a first image by the pressing member 105*b* to allow the liquid absorbing member 105*a* to absorb a liquid component contained in the first image, thereby reducing the liquid component from the first image to give a second image. As the method of reducing the liquid component in the first image, the present system of pressure contact of the liquid absorbing member may be combined with other various techniques conventionally used, such as a heating method, a method of blowing air with low humidity, and a decompression method. Such a method may be applied to a second image containing a smaller amount of the liquid component to further reduce the liquid component.

Various conditions and components of the liquid absorbing device 105 will next be described in detail.

(Pretreatment)

Figure 2:
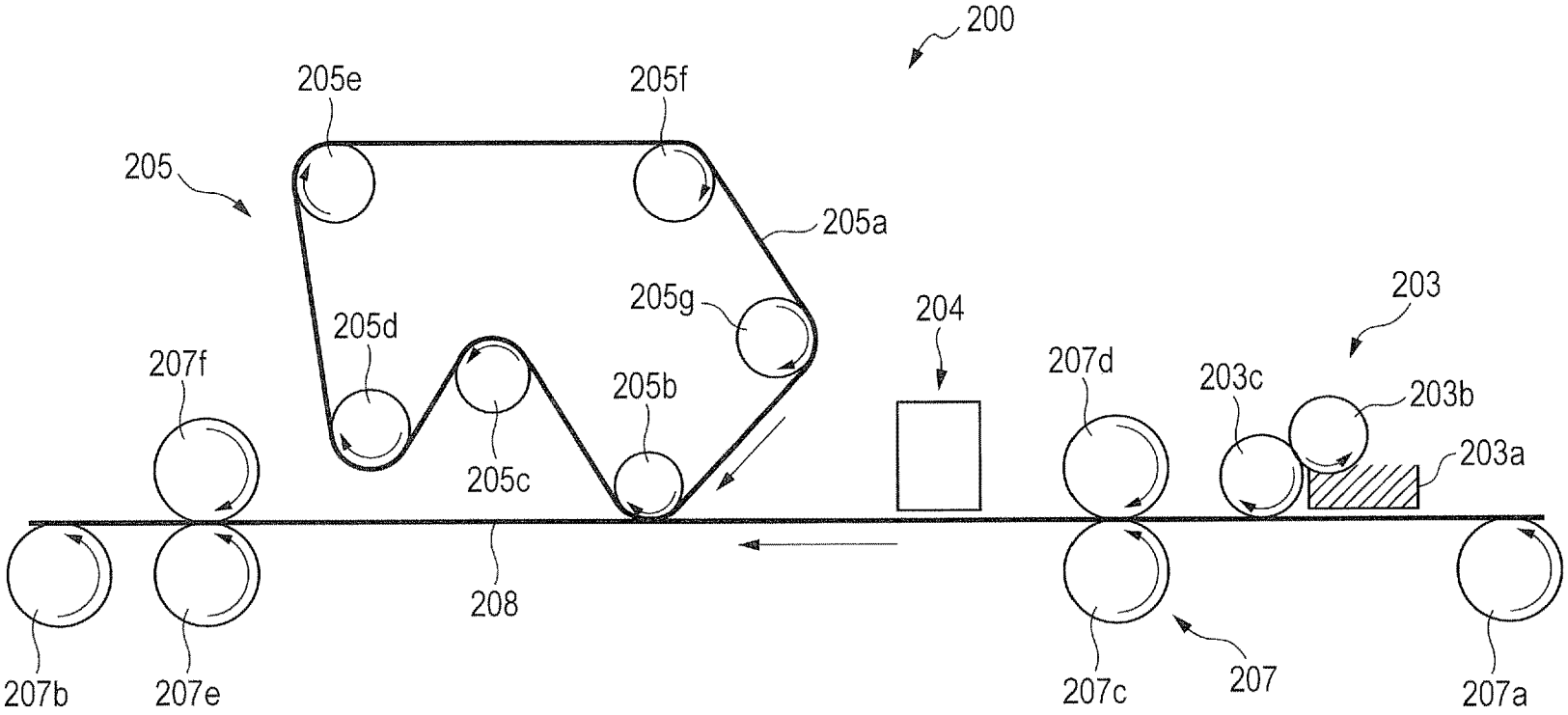
FIG. 2 is a schematic view showing an exemplary structure of a direct drawing type ink jet recording apparatus according to an embodiment of the present invention.

In the present embodiment, before the liquid absorbing member 105*a* including the porous body is brought into contact with a first image, pretreatment is preferably performed with a pretreatment device to apply a wetting liquid to the liquid absorbing member (not shown in FIGS. 1 and 2). The wetting liquid used in the present invention preferably contains water and a water-soluble organic solvent. The water is preferably a deionized water prepared by ion exchanging, for example. The water-soluble organic solvent is not limited to particular types, and any known organic solvent such as ethanol and isopropyl alcohol can be used. In the pretreatment of the liquid absorbing member used in the present invention, the application method may be any method, but immersing or liquid dropping is preferred. Although the component to adjust the surface tension of the wetting liquid is not specifically limited, a surfactant is preferably used as the component. As the surfactant, at least one of a silicone-based surfactant and a fluorinated surfactant is preferably used, and use of a fluorinated surfactant is more preferable. The content of the surfactant in the wetting liquid is preferably 0.2 mass % or more, more preferably 0.4 mass % or more, and particularly preferably 0.5 mass % or more, based on the total mass of the wetting liquid. Although the upper limit of the content of the surfactant in the wetting liquid is not specifically limited, the upper limit is preferably 10 mass % of the total mass of the wetting liquid from the point of view of the solubility of the surfactant in the wetting liquid.

(Pressing Conditions)

The pressure of the liquid absorbing member pressing against a first image on the transfer body is preferably 2.9 $N/cm^2$ (0.3 $kgf/cm^2$) or more because the liquid component in the first image can be separated by solid-liquid separation for a shorter time and the liquid component can be removed from the first image. The pressure of a liquid absorbing member in the present specification represents the nip pressure between an ink receiving medium and a liquid absorbing member, and is the value determined by the following procedure. A surface pressure distribution measuring device (I-SCAN manufactured by Nitta) is used to perform surface pressure measurement, and the load in a pressed region is divided by the area, giving the pressure.

(Application Time)

The application time for contact of the liquid absorbing member 105*a* with a first image is preferably within 50 ms (milliseconds) in order to further suppress adhesion of the coloring material in the first image to the liquid absorbing member. In the present specification, the application time is calculated by dividing the pressure detection width in a movement direction of the ink receiving medium in the above surface pressure measurement by the movement speed of the ink receiving medium. Hereinafter, the application time is called liquid absorbing nip time.

In this manner, a second image in which the liquid component is absorbed from the first image to reduce the liquid component is formed on the transfer body 101. The second image is transferred onto a recording medium 108 by the subsequent transfer unit. The device configuration and conditions for transfer will be described.

(Pressing Member for Transferring)

In the present embodiment, during contact of the second image with a recording medium 108 conveyed by a recording medium conveyance device 107, a pressing member for transferring 106 presses the recording medium 108, thereby transferring the ink image onto the recording medium 108. The second image after removal of a liquid component contained in the first image on the transfer body 101 is transferred onto the recording medium 108, and consequently a recorded image prevented from causing curing, cockling, and the like can be produced.

The pressing member 106 is required to have a certain structural strength from the viewpoint of the conveyance accuracy of a recording medium 108 and durability. As the material for the pressing member 106, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. These materials may be used in combination.

The pressing time of the pressing member 106 for transferring a second image on the transfer body 101 to a recording medium 108 is not limited to particular values, but is preferably 5 ms (milliseconds) or more to 100 ms (milliseconds) or less in order to satisfactory transfer the image and not to deteriorate the durability of the transfer body. The pressing time in the embodiment represents the time during the contact of a recording medium 108 with a transfer body 101 and is the value determined by the following procedure. A surface pressure distribution measuring device (I-SCAN manufactured by Nitta) is used to perform surface pressure measurement, and the length in the conveyance direction of a pressured area is divided by the conveyance speed, giving the pressing time.

The pressure by the pressing member 106 for transferring a second image on the transfer body 101 to a recording medium 108 is not limited to particular values, but is controlled so as to satisfactory transfer the image and not to deteriorate the durability of the transfer body. Thus, the pressure is preferably 9.8 $N/cm^2$ (1 $kgf/cm^2$) or more to 294.2 $N/cm^2$ (30 $kgf/cm^2$) or less. The pressure in the embodiment represents the nip pressure between a recording medium 108 and a transfer body 101, and is a value determined by the following procedure. A surface pressure distribution measuring device is used to perform surface pressure measurement, and the load in a pressed region is divided by the area, giving the pressure.

The temperature during pressing by the pressing member 106 for transferring a second image on the transfer body 101 to a recording medium 108 is also not limited to particular values, but is preferably not lower than the glass transition point or not lower than the softening point of the resin component contained in an ink. A preferred embodiment for heating includes a heating device for heating a second image on the transfer body 101, the transfer body 101, and a recording medium 108.

The shape of the pressing member for transferring 106 is not limited to particular shapes, but is exemplified by a roller shape.

(Recording Medium and Recording Medium Conveyance Device)

In the present embodiment, the recording medium 108 is not limited to particular media, and any known recording medium can be used. The recording medium is exemplified by long media rolled into a roll and sheet media cut into a certain size. The material is exemplified by paper, plastic films, wooded boards, corrugated cardboard, and metal films.

In FIG. 1, the recording medium conveyance device 107 for conveying the recording medium 108 is composed of a recording medium delivery roller 107*a* and a recording medium winding roller 107*b*, but may be composed of any members capable of conveying a recording medium, and is not specifically limited to the structure.

(Control System)

Figure 3:
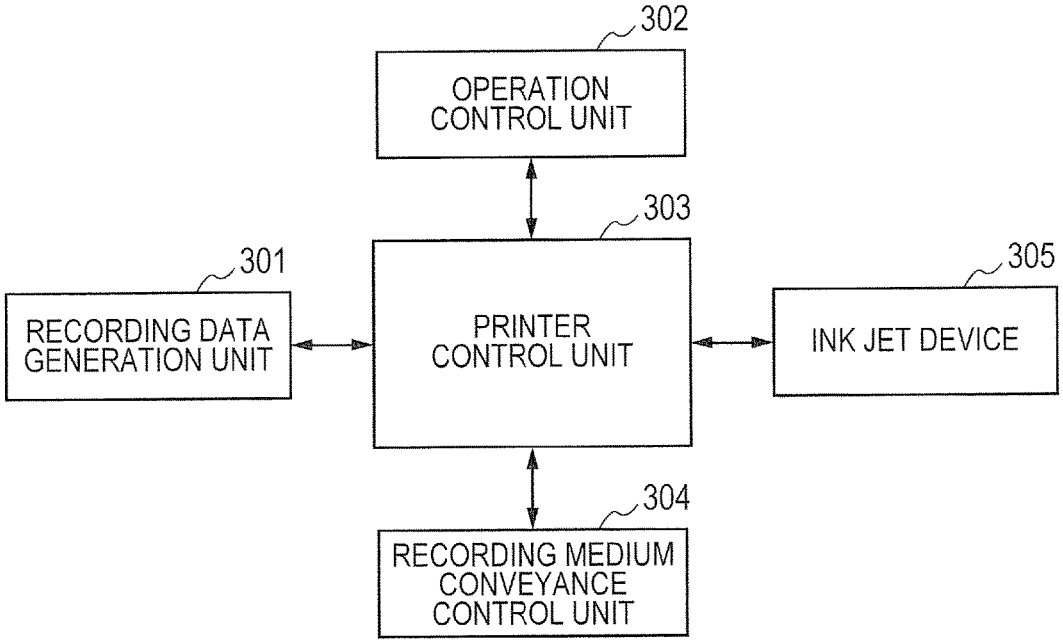
FIG. 3 is a block diagram of a control system for the whole ink jet recording apparatuses shown in FIGS. 1 and 2.

The transfer type ink jet recording apparatus in the embodiment has a control system for controlling each device. FIG. 3 is a block diagram of a control system for the whole transfer type ink jet recording apparatus shown in FIG. 1.

In FIG. 3, 301 is a recording data generation unit such as an external print server, 302 is an operation control unit such as an operation panel, 303 is a printer control unit for executing a recording process, 304 is a recording medium conveyance control unit for conveying a recording medium, and 305 is an ink jet device for printing.

Figure 4:
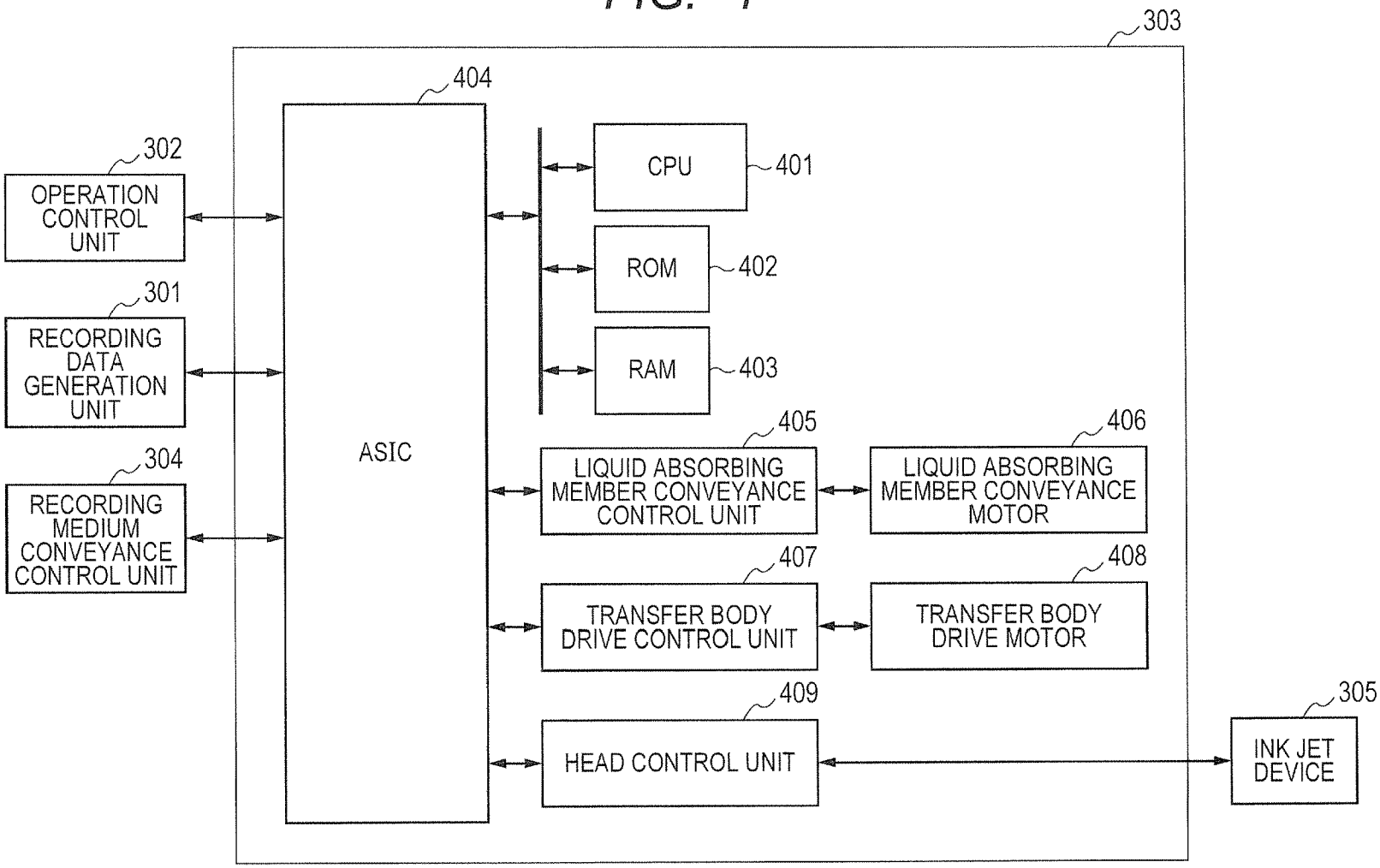
FIG. 4 is a block diagram of a printer control unit in the transfer type ink jet recording apparatus shown in FIG. 1.

FIG. 4 is a block diagram of the printer control unit in the transfer type ink jet recording apparatus in FIG. 1.

401 is a CPU for controlling the whole printer, 402 is a ROM for storing a control program for the CPU, and 403 is a RAM for executing a program. 404 is an application specific integrated circuit (ASIC) including a network controller, a serial IF controller, a controller for generating head data, a motor controller, and the like. 405 is a conveyance control unit for a liquid absorbing member for driving a conveyance motor 406 for a liquid absorbing member and is controlled by a command from the ASIC 404 via a serial IF. 407 is a transfer body drive control unit for driving a transfer body drive motor 408 and is also controlled by a command from the ASIC 404 via a serial IF. 409 is a head control unit and performs final discharge data generation for the ink jet device 305 and drive voltage generation, for example.

<Direct Drawing Type Ink Jet Recording Apparatus>

As another embodiment of the present invention, a direct drawing type ink jet recording apparatus is exemplified. In the direct drawing type ink jet recording apparatus, the ink receiving medium is a recording medium on which an image is to be formed, or a recording medium on which an intended final image is to be formed.

FIG. 2 is a schematic view showing an exemplary schematic structure of a direct drawing type ink jet recording apparatus 200 in the embodiment. As compared with the above transfer type ink jet recording apparatus, the direct drawing type ink jet recording apparatus includes the same members as the transfer type ink jet recording apparatus except that the transfer body 101, the support member 102, and the cleaning member 109 for a transfer body are not included, and an image is formed on a recording medium 208.

Hence, a reaction liquid applying device 203 for applying a reaction liquid onto the recording medium 208, an ink applying device 204 for applying an ink onto the recording medium 208, and a liquid absorbing device 205 including a liquid absorbing member 205*a* that comes into contact with a first image on the recording medium 208 to absorb a liquid component contained in the first image have the same structures as those in the transfer type ink jet recording apparatus, and are not described.

In the direct drawing type ink jet recording apparatus of the embodiment, the liquid absorbing device 205 includes the liquid absorbing member 205*a* and a pressing member 205*b* for liquid absorption that presses the liquid absorbing member 205*a* against the first image on the recording medium 208. The liquid absorbing member 205*a* and the pressing member 205*b* may have any shape, and members having substantially the same shapes as those of the liquid absorbing member and the pressing member usable in the transfer type ink jet recording apparatus can be used. The liquid absorbing device 205 may further include extending members for extending the liquid absorbing member. In FIGS. 2, 205*c*, 205*d*, 205*e*, 205*f*, and 205*g* are extending rollers as the extending members. The number of extending rollers is not limited to 5 as shown in FIG. 4, and an intended number of rollers can be arranged depending on the design of an apparatus. The direct drawing type ink jet recording apparatus may further include recording medium support members, not shown in the drawings, for supporting the recording medium from below, at a position opposed to an ink applying unit including the ink applying device 204 for applying an ink to the recording medium 208 and a position opposed to a liquid component removing unit including the liquid absorbing member 205*a* that comes into pressure contact with a first image on the recording medium to remove a liquid component.

(Recording Medium Conveyance Device)

In the direct drawing type ink jet recording apparatus of the embodiment, a recording medium conveyance device 207 is not limited to particular devices, and a conveyance device in a known direct drawing type ink jet recording apparatus can be used. As shown in FIG. 2, a recording medium conveyance device including a recording medium delivery roller 207*a*, a recording medium winding roller 207*b*, and recording medium conveyor rollers 207*c*, 207*d*, 207*e*, and 207*f* is exemplified.

(Control System)

The direct drawing type ink jet recording apparatus in the embodiment has a control system for controlling each device. A block diagram of the control system for the whole direct drawing type ink jet recording apparatus shown in FIG. 2 is as shown in FIG. 3 as with the transfer type ink jet recording apparatus shown in FIG. 1.

Figure 5:
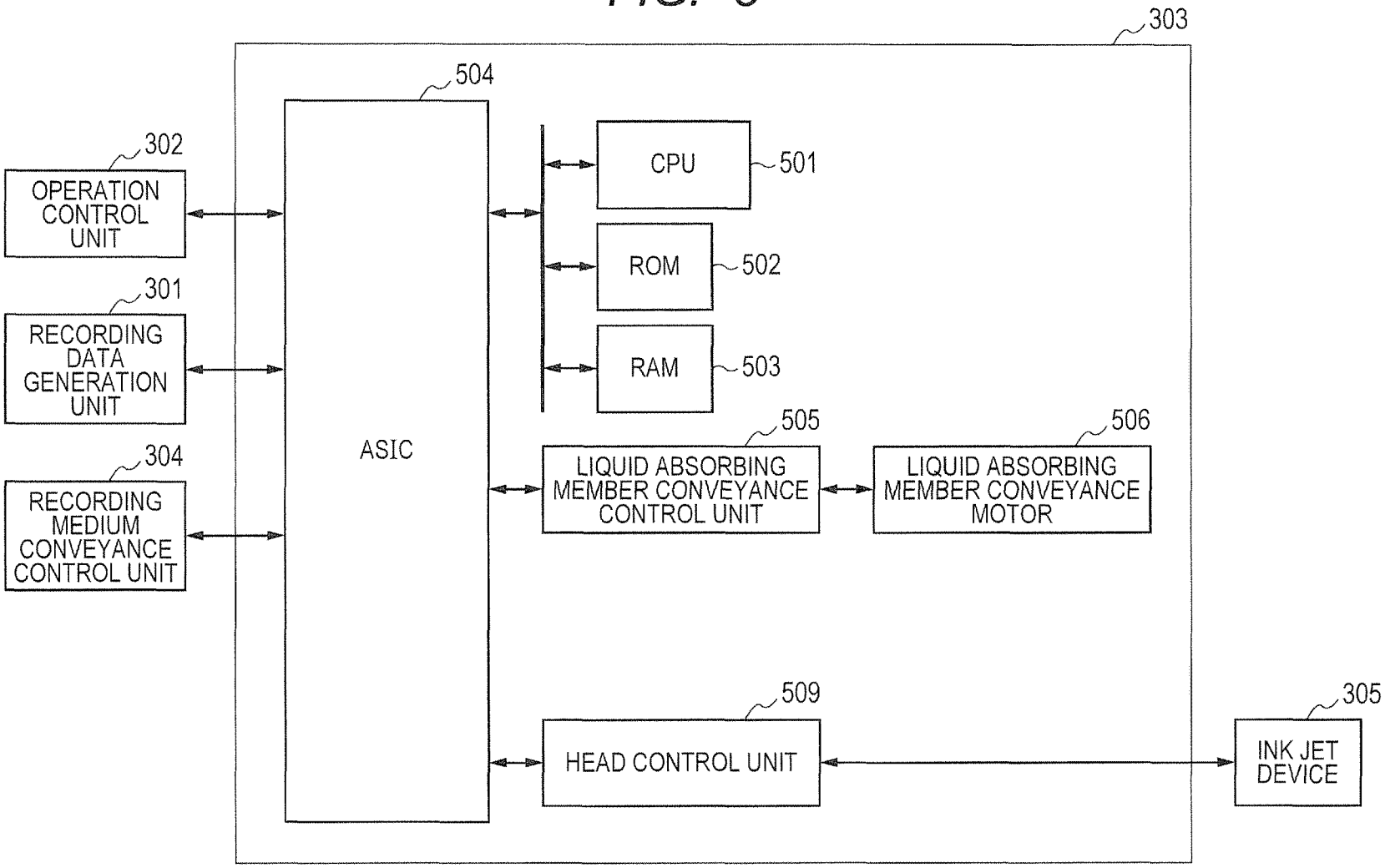
FIG. 5 is a block diagram of a printer control unit in the direct drawing type ink jet recording apparatus shown in FIG. 2.

FIG. 5 is a block diagram of the printer control unit in the direct drawing type ink jet recording apparatus in FIG. 2. The block diagram is the same as the block diagram of the printer control unit in the transfer type ink jet recording apparatus in FIG. 4 except that the transfer body drive control unit 407 and the transfer body drive motor 408 are not included.

In other words, 501 is a CPU for controlling the whole printer, 502 is a ROM for storing a control program for the CPU, and 503 is a RAM for executing a program. 504 is an ASIC including a network controller, a serial IF controller, a controller for generating head data, a motor controller, and the like. 505 is a conveyance control unit for a liquid absorbing member for driving a conveyance motor 506 for a liquid absorbing member and is controlled by a command from the ASIC 504 via a serial IF. 509 is a head control unit and performs final discharge data generation for the ink jet device 305 and drive voltage generation, for example.

According to embodiments of the present invention, an ink jet recording apparatus and an ink jet recording method capable of stably absorbing a liquid component from images can be provided.

EXAMPLES

The present invention will next be described in further detail with reference to examples and comparative examples. The present invention is not intended to be limited to the following examples without departing from the scope of the invention. In the following description in examples, "part" is based on mass unless otherwise noted.

Example 1

<Preparation of Reaction Liquid>

As the reaction liquid to be applied by a reaction liquid applying device 103, the reaction liquid having the following formulation was used. The "remainder" of ion-exchanged water is such an amount that the total amount of all the components constituting the reaction liquid will be 100.0 parts by mass (the same applies hereinafter).

| | |
|---|---|
| Glutaric acid | 21.0 parts |
| Glycerol | 5.0 parts |
| Surfactant (trade name: MEGAFACE F444, manufactured by DIC Corporation) | 5.0 parts |
| Ion-exchanged water | remainder |

<Preparation of Pigment Dispersion>

First, 10 parts of carbon black (trade name: Monarch 1100, manufactured by Cabot), 15 parts of a resin aqueous solution (prepared by neutralizing a 20.0% by mass aqueous solution of styrene-ethyl acrylate-acrylic acid copolymer having an acid value of 150 and a weight average molecular weight (Mw) of 8,000 with an aqueous potassium hydroxide), and 75 parts of pure water were mixed. The mixture was placed in a batch type vertical sand mill (manufactured by Aimex), and 200 parts of 0.3-mm zirconia beads were added. The mixture was dispersed for 5 hours while cooled with water. The prepared dispersion liquid was centrifuged to remove coarse particles, giving a black pigment dispersion having a pigment content of 10.0% by mass.

<Preparation of Resin Microparticle Dispersion>

First, 20 parts of ethyl methacrylate, 3 parts of 2,2'-azobis-(2-methylbutyronitrile), and 2 parts of n-hexadecane were mixed, and the mixture was stirred for 0.5 hour. The mixture was added dropwise to 75 parts of 8% by mass aqueous solution of styrene-butyl acrylate-acrylic acid copolymer (acid value: 130 mg KOH/g, weight average molecular weight (Mw): 7,000), and the whole was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin microparticle dispersion having a resin content of 25.0% by mass.

<Preparation of Ink>

The pigment dispersion and the resin microparticle dispersion were mixed with the components shown below.

| | |
|---|---|
| Pigment dispersion (a coloring material content of 10.0% by mass) | 40.0% by mass |
| Resin microparticle dispersion | 20.0% by mass |
| Water-soluble resin (the resin in the resin aqueous solution) | 1.5% by mass |
| Glycerol | 7.0% by mass |
| Polyethylene glycol (a number average molecular weight (Mn) of 1,000) | 2.5% by mass |
| Surfactant (trade name: Acetylenol E100, manufactured by Kawaken Fine Chemicals) | 0.5% by mass |
| Ion-exchanged water | remainder |

The components were thoroughly stirred and dispersed and then subjected to pressure filtration through a microfilter with a pore size of 3.0 μm (manufactured by Fujifilm), giving a black ink.

<Preparation of Treatment Liquid>

A treatment liquid having the following formulation was prepared.

| | |
|---|---|
| Water-soluble resin (the resin in the resin aqueous solution) | 2.5% by mass |
| Glycerol | 6.0% by mass |
| Polyethylene glycol (a number average molecular weight (Mn) of 1,000) | 2.5% by mass |
| Surfactant (trade name: Acetylenol E100, manufactured by Kawaken Fine Chemicals) | 0.5% by mass |
| Ion-exchanged water | remainder |

<Ink Jet Recording Apparatus and Image Formation>

The transfer type ink jet recording apparatus shown in FIG. 1 was used. The transfer body 101 is fixed to a surface of the support member 102 with a double-sided adhesive tape. A PET sheet having a thickness of 0.5 mm was coated with a silicone rubber (trade name: KE12, manufactured by Shin-Etsu Chemical) into a thickness of 0.3 mm, and the resulting sheet was used as the elastic layer of the transfer body 101. Glycidoxypropyltriethoxysilane and methyltriethoxysilane were mixed at a molar ratio of 1:1, and the mixture was heated and refluxed to give a condensate. The condensate was mixed with a photocationic polymerization initiator (trade name: SP150, manufactured by ADEKA) to give a mixture. Atmospheric pressure plasma treatment was performed so that the elastic layer surface would have a contact angle with water of 10 degrees or less. Then, the above mixture was applied onto the elastic layer and subjected to UV irradiation (with a high-pressure mercury lamp, an integrated exposure amount of 5,000 mJ/cm$^2$) and to thermal curing (150° C., 2 hours) to form a film, yielding a transfer body 101 including the elastic layer on which a surface layer having a thickness of 0.5 μm was formed. The surface of the transfer body 101 was maintained at 60° C. by a heater (not shown in the drawings).

Figure 6A:
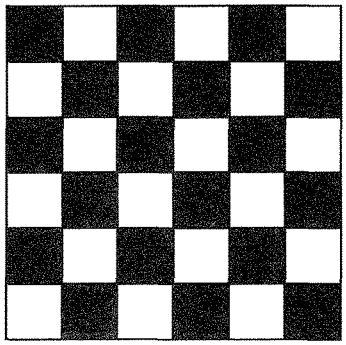
FIGS. 6A and 6B are arrangement diagrams of printing patterns in an embodiment of the present invention.
Figure 6B:
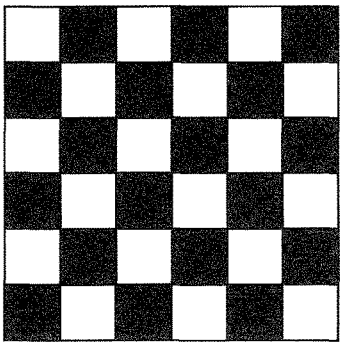

The amount of the reaction liquid applied by the reaction liquid applying device 103 was 1 g/m$^2$. As the ink applying device 104, an ink jet recording head including an electrothermal converter for discharging an ink on demand was used. The black ink was applied to form an image at an application amount of 20 g/m$^2$ in such a manner as to arrange 20-mm square patches in a 120-mm square region with a hound's-tooth pattern. The arrangement of the hound's-tooth pattern was reversed after every process, and printing was alternately performed in such printing patterns as shown in FIGS. 6A and 6B so as to alternately repeat ink image regions (black areas) and non-ink image regions (white areas). In this process, the treatment liquid was applied by using an ink jet head to the non-ink image regions shown in FIGS. 6A and 6B. In other words, for the printing pattern shown in FIG. 6A, the treatment liquid was applied in the pattern shown in FIG. 6B, and for the printing pattern shown in FIG. 6B, the treatment liquid was applied in the pattern shown in FIG. 6A. The application amount of the treatment liquid was 8 g/m$^2$. The amount of the water-soluble resin applied to the non-ink image regions was 0.2 g/m$^2$ and the amount of the water-soluble organic solvent (glycerol, polyethylene glycol, and Acetylenol E100) was 0.72 g/m$^2$.

As the liquid absorbing member 105*a*, a water-repellent polytetrafluoroethylene (water-repellent PTFE) porous body having an average pore diameter of 0.2 μm was used. The liquid absorbing member was immersed in a wetting liquid composed of 95 parts of ethanol and 5 parts of water as the pretreatment, and impregnated with the wetting liquid. The wetting liquid was then replaced with water, and the resulting liquid absorbing member was used for liquid removal. By applying a pressure with the pressing member 105*b*, the nip pressure between the transfer body 101 and the liquid absorbing member 105*a* was adjusted to an average pressure of 19.6 N/cm$^2$ (2 kgf/cm$^2$). The pressing member 105*b* used had a roller diameter of ϕ200 mm.

The conveyance speed of the liquid absorbing member 105*a* was adjusted by conveyor rollers 105*c*, 105*d*, and 105*e*, which conveyed the liquid absorbing member while extending the liquid absorbing member, so as to be substantially the same speed as the movement speed of the transfer body 101. The recording medium 108 was conveyed by the recording medium delivery roller 107*a* and the recording medium winding roller 107*b* so as to be substantially the same speed as the movement speed of the transfer body 101. The conveyance speed of the recording medium 108 was 0.5 m/s. As the recording medium 108, Aurora Coat Paper (manufactured by Nippon Paper Industries, a basis weight of 104 g/m$^2$) was used. In the example, a long rolled sheet was used as the recording medium to be recorded, but a sheet cut into a predetermined shape can be used.

The second image after liquid removal on the transfer body was brought into contact with a recording medium 108, thus the second image and the recording medium 108 were interposed between and pressed by the support member 102 and the pressing roller 106 as the pressing member, and the second image was transferred to the recording medium 108 to form an image. As the pressing conditions, the nip time was 20 msec, and the applied pressure was 147.1 N/cm$^2$ (15 kgf/cm$^2$). The transfer body after the transfer was subjected to cleaning (not shown in the drawings) to return to the initial state so as to be subjected to next application of the reaction liquid. The above process was repeated 10 times. A change of the liquid absorption amount and the adhesion amount of the coloring material to the liquid absorbing member 105*a* were evaluated after each image forming process. The evaluation results are shown in Table 1 and Table 2. The evaluation methods of the change in absorption amount and the adhesion amount of the coloring material are as described below.

<Change in Absorption Amount>

For the change of the liquid absorption amount to the liquid absorbing member 105*a*, an electronic balance (AUX-320, manufactured by Shimadzu Corporation) was used to determine a change in weight between the first image and the second image on the transfer body after each process, or a weight change before and after the liquid absorbing step.

<Adhesion Amount of Coloring Material>

For the adhesion amount of the coloring material, a change in reflectivity of the liquid absorbing member 105*a* at a wavelength λ (580 nm) before and after the liquid absorbing step was determined with a plane spectrometer (PSA-700E, manufactured by JFE Techno Research).

As shown in Table 1, the liquid was absorbed within a fluctuation range of ±3% relative to 100% of the amount of the liquid to be removed through the first to tenth absorption in Example 1, and the reduction of the absorption amount or other problems were not observed. The results indicated that satisfactory liquid absorption was able to be continued. As shown in Table 2, the adhesion amount of the coloring material was not more than 2% based on the brightness of an unused part of the liquid absorbing member (the liquid absorbing member before the liquid absorbing step) through the first to tenth absorption, and this result indicated that satisfactory liquid removal was performed without problems such as coloring material adhesion.

Example 2

The same image formation and evaluation as in Example 1 were performed except that the treatment liquid in Example 1 was changed to a clear ink prepared by removing the coloring material from the black ink used as the ink. The amount of the water-soluble resin applied to the non-ink image regions was 0.12 g/m$^2$, and the amount of the water-soluble organic solvent (glycerol, polyethylene glycol, and Acetylenol E100) was 0.8 g/m$^2$. The results are shown in Table 1 and Table 2.

Example 3

The same image formation and evaluation as in Example 1 were performed except that the application amount of the treatment liquid was 4 g/m$^2$. The amount of the water-soluble resin applied to the non-ink image regions was 0.1 g/m$^2$, and the amount of the water-soluble organic solvent (glycerol, polyethylene glycol, and Acetylenol E100) was 0.36 g/m$^2$. The results are shown in Table 1 and Table 2.

Example 4

The same image formation and evaluation as in Example 2 were performed except that the application amount of the treatment liquid was 12 g/m$^2$. The amount of the water-soluble resin applied to the non-ink image regions was 0.18 g/m$^2$, and the amount of the water-soluble organic solvent (glycerol, polyethylene glycol, and Acetylenol E100) was 1.2 g/m$^2$. The results are shown in Table 1 and Table 2.

Comparative Example 1

The same image formation and evaluation as in Example 1 were performed except that no treatment liquid was applied. The results are shown in Table 1 and Table 2.

Comparative Example 2

The same image formation and evaluation as in Example 1 were performed except that the content of the water-soluble resin in treatment liquid was 0%. The amount of the water-soluble resin applied to the non-ink image regions was 0 g/m$^2$, and the amount of the water-soluble organic solvent (glycerol, polyethylene glycol, and Acetylenol E100) was 0.72 g/m$^2$. The evaluation results are shown in Table 1 and Table 2.

Comparative Example 3

The same sample image formation and evaluation as in Example 1 were performed except that the content of the water-soluble organic solvent (glycerol, polyethylene glycol, and Acetylenol E100) in the treatment liquid was 0%. The amount of the water-soluble resin applied to the non-ink image regions was 0.2 g/m$^2$, and the amount of the water-soluble organic solvent (glycerol, polyethylene glycol, and Acetylenol E100) was 0 g/m$^2$. The evaluation results are shown in Table 1 and Table 2.

The above results have revealed that a stable absorption amount was able to be maintained without coloring material adhesion to the absorbing member in the examples in which the treatment liquid containing the water-soluble resin and the water-soluble organic solvent was applied to the non-ink image regions. The effect was particularly marked when the application amount of the water-soluble organic solvent was 0.3 g/m$^2$ or more to 1.2 g/m$^2$ or less.

In place of the transfer type ink jet recording apparatus, the direct drawing type ink jet recording apparatus shown in FIG. 2 for applying a reaction liquid directly to a recording medium and applying an ink was used to perform the same experiments. In the image formation with the direct drawing type ink jet recording apparatus shown in FIG. 2, GLORIA PURE WHITE with a basis weight 210 g/m$^2$ (manufactured by Gojo Paper) was used as the recording medium 208. The reaction liquid, the reaction liquid applying device 203, the ink, the ink applying device 204, the conveyance speed of the recording medium 208, and the liquid absorbing device 205 were in the same conditions as for the transfer type ink jet recording apparatus in Example 1 except the recording medium 208, and the image formation and evaluation were performed. Consequently, it was ascertained that the same evaluation results as Example 1 were obtained.

TABLE 1

| | Absorption amount [%] | | | | | | | | | |
|---|---|---|---|---|---|---|---|---|---|---|
| | 1st | 2nd | 3rd | 4th | 5th | 6th | 7th | 8th | 9th | 10th |
| Example 1 | 90 | 93 | 89 | 91 | 89 | 91 | 87 | 90 | 92 | 91 |
| Example 2 | 93 | 90 | 90 | 91 | 87 | 92 | 89 | 92 | 90 | 90 |

TABLE 1-continued

| | Absorption amount [%] | | | | | | | | | |
|---|---|---|---|---|---|---|---|---|---|---|
| | 1st | 2nd | 3rd | 4th | 5th | 6th | 7th | 8th | 9th | 10th |
| Example 3 | 91 | 90 | 93 | 89 | 92 | 87 | 92 | 90 | 91 | 90 |
| Example 4 | 90 | 92 | 90 | 91 | 90 | 88 | 88 | 85 | 82 | 80 |
| Comparative Example 1 | 92 | 75 | 76 | 54 | 55 | 40 | 42 | 21 | 20 | 5 |
| Comparative Example 2 | 91 | 85 | 84 | 79 | 80 | 75 | 73 | 72 | 70 | 67 |
| Comparative Example 3 | 90 | 80 | 81 | 77 | 75 | 71 | 70 | 68 | 67 | 62 |

TABLE 2

| | Coloring material adhesion amount [%] | | | | | | | | | |
|---|---|---|---|---|---|---|---|---|---|---|
| | 1st | 2nd | 3rd | 4th | 5th | 6th | 7th | 8th | 9th | 10th |
| Example 1 | 0 | 2 | 1 | 1 | 0 | 2 | 0 | 1 | 1 | 2 |
| Example 2 | 2 | 2 | 1 | 0 | 1 | 1 | 2 | 0 | 1 | 1 |
| Example 3 | 1 | 1 | 2 | 2 | 1 | 2 | 2 | 2 | 2 | 2 |
| Example 4 | 1 | 2 | 2 | 3 | 4 | 3 | 4 | 4 | 5 | 5 |
| Comparative Example 1 | 1 | 8 | 10 | 25 | 23 | 38 | 40 | 48 | 52 | 54 |
| Comparative Example 2 | 0 | 7 | 6 | 10 | 11 | 14 | 16 | 20 | 21 | 25 |
| Comparative Example 3 | 2 | 7 | 5 | 12 | 11 | 18 | 18 | 25 | 23 | 30 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016158, filed Jan. 29, 2016, which is hereby incorporated by reference herein in its entirety.

What is claimed is:

1. An ink jet recording method comprising:

(a) a step of forming a first ink image containing a first liquid and a coloring material on an ink receiving medium; and (b) a liquid absorbing step of bringing a liquid absorbing member that includes a porous body into contact with the first ink image to allow the porous body to absorb at least some of the first liquid from the first ink image to form a second ink image as a liquid reduced ink image, wherein the step of forming the first ink image includes:

(i) a step of applying a reaction liquid containing a reaction component that increases the viscosity of an ink onto the ink receiving medium, and (ii) a step of applying an ink containing the coloring material onto a part of a region onto which the reaction liquid is applied on the ink receiving medium, and wherein the ink jet recording method further comprises, before the liquid absorbing step, a step of applying a treatment liquid to at least a region to which the reaction liquid has been applied but the ink is not applied, the treatment liquid containing no coloring material but containing at least a water-soluble resin and a water-soluble organic solvent, and a mixture of the reaction liquid and the treatment liquid on the ink receiving medium being more viscously thickened than the reaction liquid.

2. The ink jet recording method according to claim 1, wherein the first liquid contains water.

3. The ink jet recording method according to claim 1, wherein an amount of the water-soluble organic solvent applied to the region to which the reaction liquid has been applied, but the ink is not applied, is 0.3 $g/m^2$ or more to 1.2 $g/m^2$ or less.

4. The ink jet recording method according to claim 1, wherein a surface of the porous body on a first face that comes into contact with the first ink image has an average pore diameter of 10 μm or less.

5. The ink jet recording method according to claim 1, wherein the step of applying the reaction liquid onto the ink receiving medium, the step of applying the ink onto the ink receiving medium, the step of applying the treatment liquid, and the liquid absorbing step are performed in this order.

6. The ink jet recording method according to claim 1, wherein the ink receiving medium is a transfer body configured to temporarily hold the first ink image and the second ink image, and the ink jet recording method further comprises a step of transferring the second ink image to a recording medium on which a final image is to be formed.

7. The ink jet recording method according to claim 1, wherein the ink receiving medium is a recording medium on which a final image is to be formed, and the liquid absorbing step is a step of bringing the liquid absorbing member that includes the porous body into contact with the first ink image on the recording medium, to allow the porous body to absorb at least some of the first liquid from the first ink image to form the second ink image.

8. An ink jet recording apparatus comprising:

(a) an image forming unit configured to form a first ink image containing a first liquid and a coloring material on an ink receiving medium; and (b) a liquid absorbing member that includes a porous body configured to come into contact with the first ink image to absorb at least some of the first liquid from the first ink image to form a second ink image as a liquid reduced ink image, wherein the image forming unit includes:

(i) a device configured to apply a reaction liquid containing a reaction component that increases the viscosity of an ink onto the ink receiving medium, and (ii) a device configured to apply an ink containing the coloring material onto a part of a region onto which the reaction liquid is applied on the ink receiving medium, and wherein the ink jet recording apparatus further comprises a mechanism configured to apply, before the first ink image comes into contact with the liquid absorbing member, a treatment liquid to at least a region to which the reaction liquid has been applied but the ink is not applied, the treatment liquid containing no coloring material but containing at least a water-soluble resin and a water-soluble organic solvent, and a mixture of the reaction liquid and the treatment liquid on the ink receiving medium being more viscously thickened than the reaction liquid.

9. The ink jet recording apparatus according to claim 8, wherein the first liquid contains water.

10. The ink jet recording apparatus according to claim 8, wherein the mechanism configured to apply the treatment liquid is a mechanism configured to apply the water-soluble organic solvent in an amount of 0.3 $g/m^2$ or more to 1.2 $g/m^2$ or less.

11. The ink jet recording apparatus according to claim 8, wherein a surface of the porous body on a first face that comes into contact with the first ink image has an average pore diameter of 10 μm or less.

12. The ink jet recording apparatus according to claim 8, wherein the device configured to apply the reaction liquid onto the ink receiving medium, the device configured to apply the ink onto the ink receiving medium, the mechanism configured to apply the treatment liquid, and the liquid absorbing member are arranged in this order.

13. The ink jet recording apparatus according to claim 8, wherein the ink receiving medium is a transfer body configured to temporarily hold the first ink image and the second ink image, and the ink jet recording apparatus further comprises a transfer unit that includes a pressing member configured to transfer the second ink image to a recording medium on which a final image is to be formed.

14. The ink jet recording apparatus according to claim 8, wherein the ink receiving medium is a recording medium on which a final image is to be formed.

15. An ink jet recording method comprising:

(a) a step of forming a first ink image containing a first liquid and a coloring material on an ink receiving medium by using at least an ink; and (b) a liquid absorbing step of bringing a liquid absorbing member that includes a porous body into contact with the first ink image to concentrate the ink constituting the first ink image to form a second ink image as a liquid reduced ink image, wherein the step of forming the first ink image includes:

(i) a step of applying a reaction liquid containing a reaction component that increases the viscosity of an ink onto the ink receiving medium, and (ii) a step of applying the ink, which contains the coloring material, onto a part of a region onto which the reaction liquid is applied on the ink receiving medium, and wherein the ink jet recording method further comprises, before the liquid absorbing step, a step of applying a treatment liquid to at least a region to which the reaction liquid has been applied but the ink is not applied, the treatment liquid containing no coloring material but containing at least a water-soluble resin and a water-soluble organic solvent, and a mixture of the reaction liquid and the treatment liquid formed by applying the treatment liquid on the ink receiving medium being more viscously thickened than the reaction liquid.

16. An ink jet recording apparatus comprising:

(a) an image forming unit configured to form a first ink image containing a first liquid and a coloring material on an ink receiving medium by using at least an ink; and (b) a liquid absorbing member that includes a porous body configured to come into contact with the first ink image to concentrate the ink constituting the first ink image to form a second ink image as a liquid reduced ink image, wherein the image forming unit includes:

(i) a device configured to apply a reaction liquid containing a reaction component that increases the viscosity of an ink onto the ink receiving medium, and (ii) a device configured to apply the ink, which contains the coloring material, onto a part of a region onto which the reaction liquid is applied on the ink receiving medium, and wherein the ink jet recording apparatus further comprises a mechanism configured to apply, before the first ink image comes into contact with the liquid absorbing member, a treatment liquid to at least a region to which the reaction liquid has been applied but the ink is not applied, the treatment liquid containing no coloring material but containing at least a water-soluble resin and a water-soluble organic solvent, and a mixture of the reaction liquid and the treatment liquid on the ink receiving medium being more viscously thickened than the reaction liquid.

* * * * *